US008912990B2

(12) United States Patent
Vieri et al.

(10) Patent No.: US 8,912,990 B2
(45) Date of Patent: Dec. 16, 2014

(54) DISPLAY HAVING A TRANSISTOR-DEGRADATION CIRCUIT

(75) Inventors: Carlin Vieri, Redwood City, CA (US); Ahmad Al-Dahle, Santa Clara, CA (US); Yongman Lee, Pleasanton, CA (US); Wei Yao, Freemont, CA (US)

(73) Assignee: Apple Inc., Cupertino, CA (US)

( * ) Notice: Subject to any disclaimer, the term of this patent is extended or adjusted under 35 U.S.C. 154(b) by 1699 days.

(21) Appl. No.: 12/331,308

(22) Filed: Dec. 9, 2008

(65) Prior Publication Data

US 2009/0273550 A1 Nov. 5, 2009

Related U.S. Application Data

(60) Provisional application No. 61/046,737, filed on Apr. 21, 2008.

(51) Int. Cl.
*G09G 3/36* (2006.01)

(52) U.S. Cl.
CPC ..... *G09G 3/3648* (2013.01); *G09G 2320/043* (2013.01); *G09G 2320/029* (2013.01)
USPC ..... 345/87; 345/100; 345/92; 345/99

(58) Field of Classification Search
USPC ..... 345/87–102; 324/760.01
See application file for complete search history.

(56) References Cited

U.S. PATENT DOCUMENTS 5,179,345 A * 1/1993 Jenkins et al. ..... 324/678
6,259,424 B1 * 7/2001 Kurogane ..... 345/93
6,344,877 B1 * 2/2002 Gowda et al. ..... 348/245
6,978,407 B2 12/2005 Duan et al.
7,123,044 B2 * 10/2006 Orii et al. ..... 324/760.02
7,145,358 B2 12/2006 Ando
7,205,973 B2 * 4/2007 Ma et al. ..... 345/102
7,225,375 B2 5/2007 Cochran et al.
7,486,100 B2 * 2/2009 Sakaguchi et al. ..... 324/760.01
7,525,334 B2 * 4/2009 Shimizume et al. ..... 324/760.01
2006/0022907 A1 * 2/2006 Uchino et al. ..... 345/76
2006/0208971 A1 * 9/2006 Deane ..... 345/76
2006/0208979 A1 * 9/2006 Fish et al. ..... 345/81
2007/0057887 A1 * 3/2007 Itakura et al. ..... 345/90
2007/0182442 A1 * 8/2007 Hata et al. ..... 324/770
2007/0290947 A1 12/2007 Cok
2007/0290957 A1 12/2007 Cok
2007/0290958 A1 12/2007 Cok
2008/0030446 A1 * 2/2008 Asano ..... 345/87
2008/0042943 A1 2/2008 Cok
2008/0055209 A1 3/2008 Cok
2008/0055210 A1 3/2008 Cok
2008/0111804 A1 * 5/2008 Choi et al. ..... 345/205
2008/0211397 A1 * 9/2008 Choi ..... 313/504
2009/0160838 A1 * 6/2009 So ..... 345/211

FOREIGN PATENT DOCUMENTS

JP 9152463 6/1997
JP 2006195312 * 1/2005 ..... G09G 3/30

* cited by examiner

*Primary Examiner* — Jason Olson
*Assistant Examiner* — Linh N Hoffner
(74) *Attorney, Agent, or Firm* — Fletcher Yoder PC

(57) ABSTRACT

Systems, methods, and devices are disclosed, including a device having a liquid-crystal display (LCD) panel that includes a transistor-degradation circuit. In some embodiments, the transistor-degradation circuit is configured to output a signal indicative of a change in a property of a transistor on the LCD panel over time.

50 Claims, 10 Drawing Sheets

DISPLAY HAVING A TRANSISTOR-DEGRADATION CIRCUIT

CROSS REFERENCE TO RELATED APPLICATIONS

This application is a Non-Provisional Patent Application claiming priority to US Provisional Patent Application No. 61/046,737, entitled "DISPLAY HAVING A TRANSISTOR-DEGRADATION CIRCUIT", filed Apr. 21, 2008, which is herein incorporated by reference in its entirety.

BACKGROUND OF THE INVENTION

1. Field of the Invention

The present invention relates generally to displays and, in some embodiments, to displays having a transistor-degradation circuit.

2. Description of the Related Art

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Liquid-crystal displays (LCDs) are used in a variety of electronic devices, such as televisions, computer monitors for desktop and laptop computers, and specialized equipment like automated teller machines, medical devices, and industrial equipment. LCD panels are also used frequently in portable electronic devices, such as cell phones, global-positioning-satellite (GPS) units, and hand-held media players.

Typically, LCD panels include an array of pixels for displaying images. The pixels often each include three or more sub-pixels that each display a color, e.g., red, blue, green, and in some instances, white light. To display an image, the appropriate sub-pixels on the display are rendered transmissive to light, allowing color-filtered light to pass through each of the transmissive sub-pixels and form the image. The sub-pixels are often arranged in a grid and can be addressed, e.g., individually adjusted, according to their row and column in the grid. Generally, each sub-pixel includes a transistor that is controlled according to row and column signals. For instance, the gate of a transistor in a sub-pixel may connect to a gate line generally extending in the column direction, and a source of the transistor in the sub-pixel may connect to a source line generally extending in the row direction. Often, a plurality of the transistors in the same column have gates connected to the same gate line, and a plurality of the transistors in the same row have sources connected to the same source line. An individual sub-pixel is typically addressed by turning on its transistor through the gate line, and transmitting image data relevant to the individual sub-pixel through its source line. By repeating this addressing process for each of the pixels in the display, an image may be formed, and by sequentially displaying changing images, video may be displayed.

Some components of LCD panels perform differently as the LCD panel ages. Each of the gate lines is often controlled by a number of gate-line transistors disposed at one end of the gate line. Typically, at least one gate-line transistor, having a high duty cycle, is employed to pull the gate line down, as will be described further below. Generally, the gate-line transistor is disposed in series between the transistors in the sub-pixels and a voltage source that tends to turn off the transistors in the sub-pixels. Accordingly, the gate-line transistor is typically in a conductive state except when its associated sub-pixels are being addressed, as the transistors of non-addressed sub-pixels are typically left in an off state to preserve the light-transmitting state of the sub-pixels. When the LCD panel is operating, a given column of sub-pixels is addressed relatively infrequently, as LCD panels often include a large number, e.g., several hundred or several thousand, columns of sub-pixels, and one column of sub-pixels (or some other subset) is addressed at a time. As a result, in some LCD panels, the gate-line transistors spend a substantial portion of the panel's life in a conductive state, holding the transistors on their gate line in an off state. This high duty cycle often results in the properties of the gate-line transistors changing during the life of the panel. For instance, the threshold voltage of the gate-line transistors may increase over the life of the panel.

The rate of change, however, is difficult to predict. Thermal variations across the display may affect the rate of change in the threshold voltage, and process variations during the manufacture of the display may affect the rate of change in the threshold voltage. Consequently, it has proven difficult to estimate the change in the threshold voltage of the gate-line transistors.

BRIEF SUMMARY

Systems, methods, and devices are disclosed, including a device having a liquid-crystal display (LCD) panel that includes a transistor-degradation circuit. In some embodiments, the transistor-degradation circuit is configured to output a signal indicative of a change in a property of a transistor on the LCD panel over time, such as a change in the threshold voltage of the transistor.

BRIEF DESCRIPTION OF THE DRAWINGS

Advantages of the invention may become apparent upon reading the following detailed description and upon reference to the drawings in which.

DETAILED DESCRIPTION OF SPECIFIC EMBODIMENTS

One or more specific embodiments of the present invention will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Figure 1:
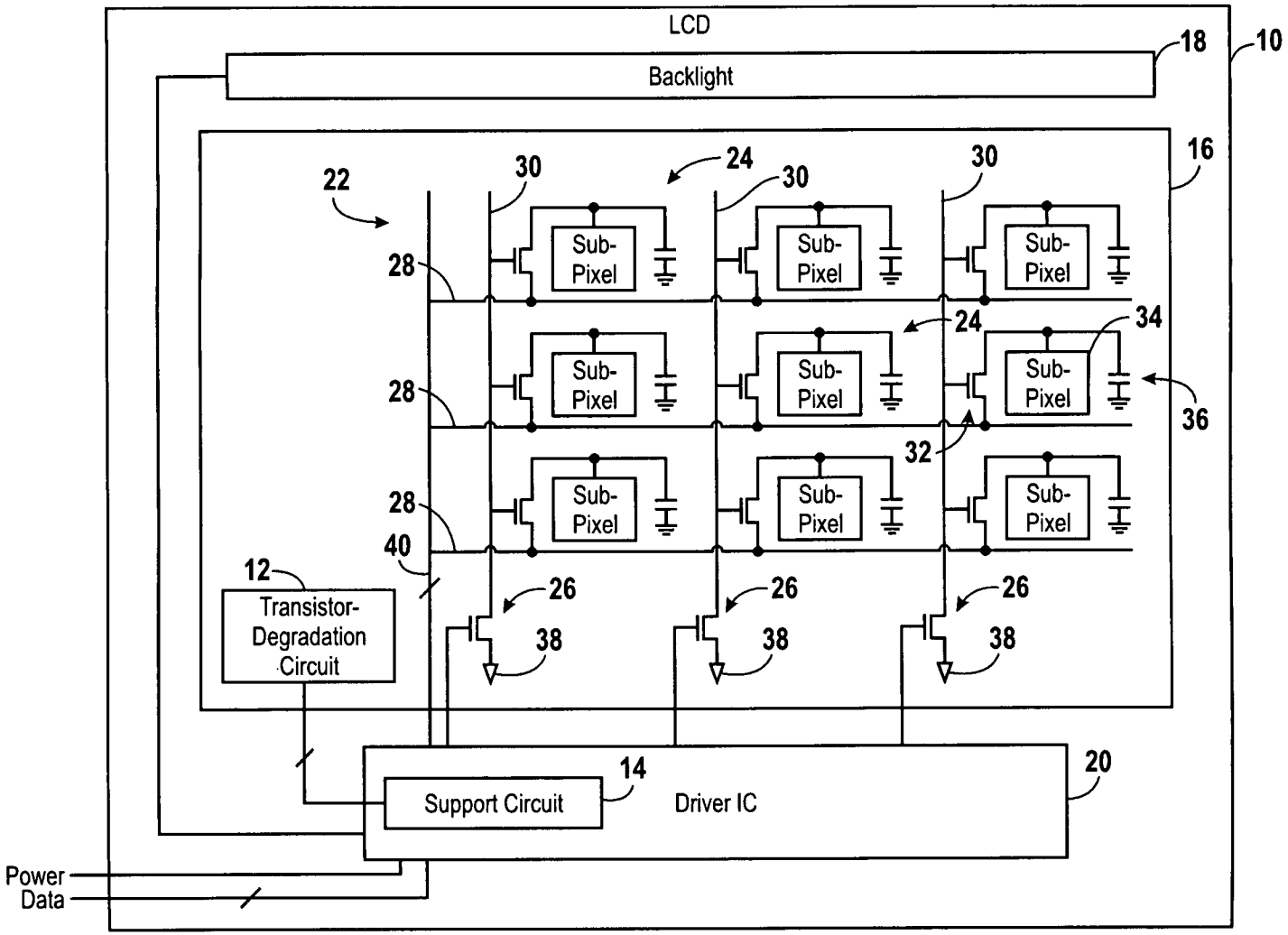
FIG. 1 illustrates an example of an LCD in accordance with an embodiment of the present technique.

FIG. 1 illustrates an example of an LCD 10 having a transistor-degradation circuit 12. As explained below, the transistor-degradation circuit 12 may output a signal indicative of a change in the properties of transistors in the LCD 10. A support circuit 14 receives this signal and produces data about the state of the transistors in the LCD 10. The transistor-degradation circuit 12 and the support circuit 14 are described further below, after describing other aspects of the LCD 10.

In this embodiment, the LCD 10 includes an LCD panel 16, a backlight 18, and a driver integrated circuit (IC) 20. The LCD panel may be any of a variety of types of LCD panels, including a twisted nematic (TN) panel, an in-plane switching (IPS) panel, a multi-domain vertical alignment (MVA) panel, a patterned vertical alignment (PVA) panel, or a super patterned vertical alignment (S-PVA) panel, for example. In other embodiments, other types of displays may be used, such as a plasma display, an organic light emitting diode display, an electronic ink display, or other displays having transistors with properties that change over time.

The LCD panel 16 may include a plurality of devices that are formed on a substrate, e.g., a glass substrate. In this embodiment, the LCD panel 16 includes the transistor-degradation circuit 12, an array 22 of sub-pixels 24, and a plurality of gate-line transistors 26, all formed on a substrate. The illustrated sub-pixels 24 may be generally arranged in rows and columns with each sub-pixel 24 in a row coupled to a source line 28 and each sub-pixel 24 in a column coupled to a gate line 30. The illustrated sub-pixels 24 are generally arranged in a rectangular lattice, but in other embodiments they may be arranged differently, e.g., in a hexagonal lattice.

Each of the illustrated sub-pixels 24 may include an access transistor 32, a light switch 34, and a capacitor 36. The access transistors 32 may be formed on the panel 16 by depositing a semiconductor, such as amorphous silicon or polycrystalline silicon, on the panel 16 and patterning the semiconductive material with lithography, e.g., photolithography. The semiconductive material may be selectively doped to form a source, a drain, and a channel in each of the access transistors 32, and an insulator, such as silicon dioxide, and a conductive material may be patterned on the substrate 16 to form a gate adjacent the channel in each of the access transistors 32. The light switch 34 may include a liquid crystal disposed between two conductive transparent or translucent electrodes and two generally orthogonally-oriented light-polarizing layers. Biasing the electrodes may orient the liquid crystal such that light may be selectively transmitted through the light-polarizing layers according to the electrical state of the electrodes. A color filter may be disposed across each sub-pixel 24 to selectively transmit a particular frequency of light, e.g., red, blue, or green, such that applying a voltage to the sub-pixel 24 renders the sub-pixels 34 generally transparent or translucent to certain frequencies of light. The capacitor 36 may include a plate coupled to one of the electrodes in the sub-pixel 24 and another plate coupled to a common voltage source, e.g. ground, or an adjacent gate line 30. The capacitor 36 may generally maintain a voltage across the electrodes in the sub-pixel 24 when the sub-pixel 24 is not being addressed.

The gates of each of the access transistors 32 may be connected to one of the gate lines 30, which may be generally integrally formed with the gate of the access transistors 32, or it may be formed in a different step. The illustrated gate lines 30 couple to a plurality of sub-pixels 24 disposed in a given column. In some embodiments, the gate lines 30 are coupled at one end to a load circuit that tends to render the access transistors 32 conductive and at the other end to a pull-down voltage source 38 that tends to render the access transistors 32 nonconductive. The source and drain of the illustrated gate-line transistors 26 may be coupled in series between the pull-down voltage source 38 and the gate lines 30, such that the gate-line transistors 26 control whether the access transistors 32 on a given gate line 30 are conductive or nonconductive. A gate of each of the gate-line transistors 26 may be coupled to the driver IC 20. Alternatively, the gate control signal for the gate-line transistors 26 may be generated on the LCD, under less direct control from the driver IC 20.

The sources of the access transistors 32 on a given row may be connected to a source line 28, which like the other features on the panel 16, may be formed by deposition, lithography, and etching. The source-lines 28 may connect to the driver IC 20 through a source-line bus 40. Image data, such as the degree to which a given light switch 34 in a given sub-pixel 24 should transmit light, may be transmitted from the driver IC 20 to the sub-pixels 24 via the source-line bus 40 and the appropriate source line 28. The image data may be in the form of a voltage that when formed across the electrodes in the light switch, allows the appropriate amount of light through the light switch.

The transistor-degradation circuit 12 may be formed on the LCD panel 16. In some embodiments, the transistor-degradation circuit 12 may be formed generally simultaneously with the access transistors 32 and the gate-line transistors 26 using the same deposition, lithography, etching, and doping steps. Several examples of the transistor-degradation circuit 12 are described below with reference to FIGS. 8-10. In these examples, the transistor-degradation circuit 12 may be configured to output a signal indicative of a change in a property of the gate-line transistors 26, such as their threshold voltage. In other embodiments, the transistor-degradation circuit 12 may output a signal indicative of changes in other transistors, such as the access transistors 32, or changes in other devices on the LCD panel 16 over time.

The backlight 18 may be configured to supply light to one side of the sub-pixels 24. In some embodiments, the backlight 18 includes one or more fluorescent lights or one or more light-emitting diodes, e.g. white-light emitting diodes. A light-guide and a reflective layer may distribute light from the backlight 18 generally evenly among the sub-pixels 24, which may selectively transmit this light. In some embodiments, the sub-pixels 24 are transflective sub-pixels that have a reflective portion that selectively reflects ambient light and a transmissive portion that selectively transmits light from the backlight 18.

The driver IC 20 may include a chip, e.g., an application-specific integrated circuit (ASIC), that is configured to control various aspects of the LCD 10. In some embodiments, the driver IC 20 includes the support circuit 14 and circuitry configured to address each of the sub-pixels 24 based on image data. The illustrated embodiment includes a single driver IC 20 coupled to the LCD panel 16, but other embodiments may include a plurality of driver ICs. For example, some embodiments may include a plurality of driver ICs disposed along the bottom and the side of the LCD panel 16, and each driver IC may control a subset of the gate lines 30 or the source lines 28. In some embodiments, the driver IC 20 may be mechanically and electrically coupled to the LCD panel 16 via a tape carrier package or other technique.

In operation, the driver IC 20 receives image data and, based on this data, outputs signals that adjust the sub-pixels 24. The image data may be received from other components of an electronic device including the LCD 10. The image data may indicate which sub-pixels 24 should be rendered transmissive and the degree to which they should be rendered transmissive to form an image conveyed by the image data, such as a frame in a video. To display the image, the driver IC 20 generally individually accesses each column of sub-pixels 24 and adjusts the voltage across the electrodes in each of the light switches 34 in those sub-pixels 24. To access a column of sub-pixels 24, in this embodiment, the driver IC 20 may turn off, either directly or indirectly, the gate-line transistor 26 associated with the column of sub-pixels 24 being addressed. Turning off the gate-line transistor 26 may impede or prevent the pull-down voltage source 38 from holding down the voltage of the gate line 30, and the voltage of the addressed gate line 30 may rise in response to the gate-line transistor 26 being turned off, as current flowing between the gate line 30 and a load circuit may increase the voltage of the gate line 30. This change in voltage may render the access transistors 32 on the addressed column conductive. Image data appropriate for the addressed column may be transmitted from the driver IC 20 to each of the source lines 28. The voltages of the source lines 28 may drive current between the source lines 28 and both the capacitor 36 and the electrodes in the light switches 34, thereby updating the light-conductive state of the light switches 34 according to the image data. After the sub-pixels 24 in a column are adjusted, the gate-line transistor 26 for that column may turn back on, and the pull-down voltage source 38 may lower the voltage of the gate line 30 and turn off the access transistors 32 on that column, thereby impeding the sub-pixels 24 from changing until the next time that they are addressed. The driver IC 20 may repeat this process for each of the gate lines 30 to produce an image. In some embodiments, groups of sub-pixels 24 each having a filter of a different color may together form a single pixel of the resulting image.

The illustrated array 22 includes three rows of sub-pixels and three columns of sub-pixels, but other embodiments may include substantially more sub-pixels. Having a large number of sub-pixels 24 may increase the duty cycle of the gate-line transistors 26. Because each gate-line transistor 26 in the present embodiment is generally turned on except when addressing sub-pixels 24 coupled to its gate line 30, each of the gate-line transistors 26 may be turned on for substantial portion of the life of the LCD 10, as there may be a substantial number of gate-line transistors 26 and the gate-line transistors 26 are generally turned off one at a time. For example, the gate-line transistors 26 may be turned on more than 99% of the time in which the LCD 10 is operating. As a result, in some embodiments, properties of the gate-line transistors, such as their threshold voltage, may change over time.

Figure 2:
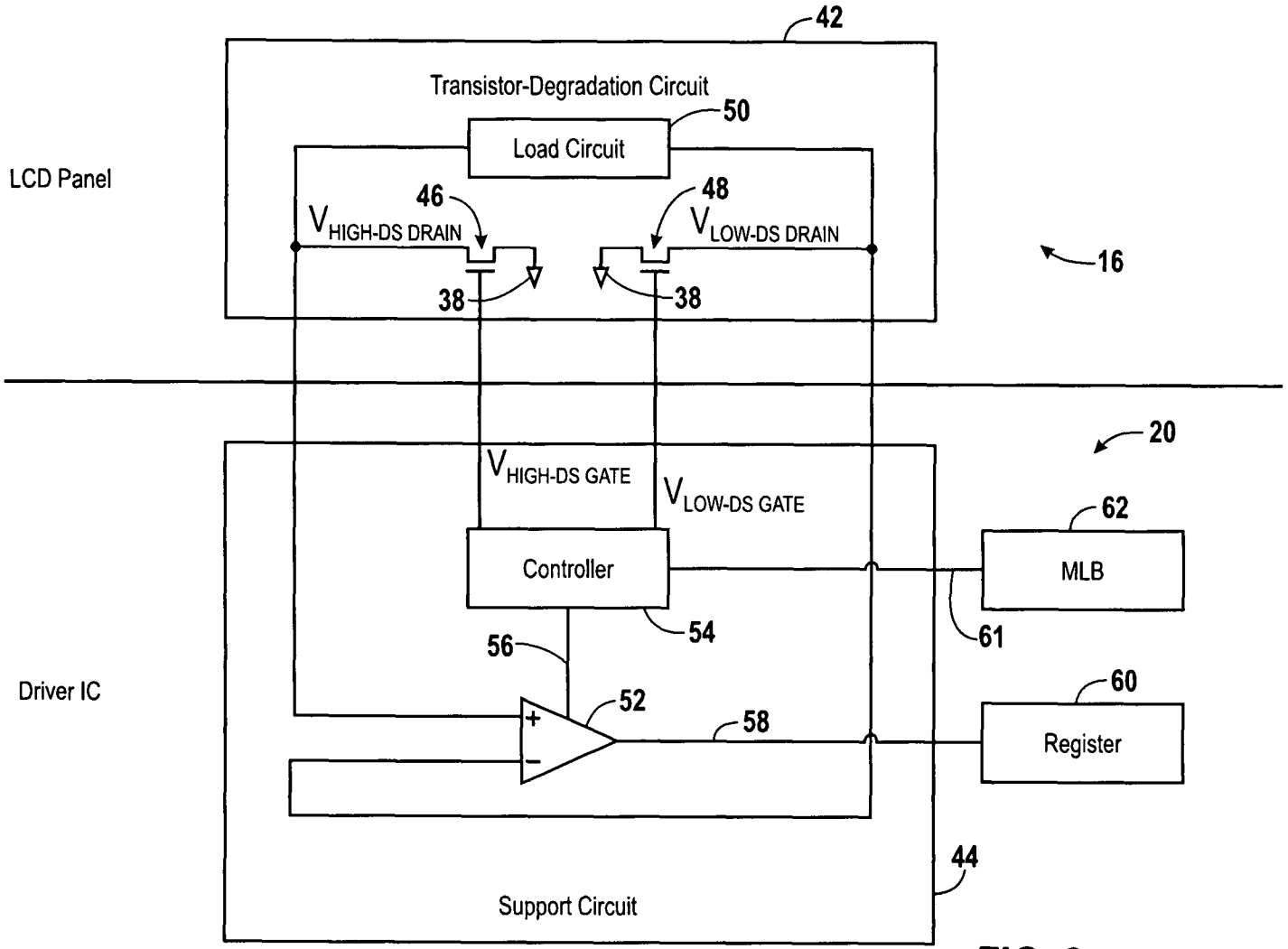
FIG. 2 illustrates an example of a transistor-degradation circuit in accordance with an embodiment of the present technique.

FIG. 2 illustrates an embodiment of a transistor-degradation circuit 42 and a support circuit 44, which are examples of the transistor-degradation circuit 12 and the support circuit 14 illustrated by FIG. 1. In this embodiment, the transistor-degradation circuit 42 is integrally formed on the LCD panel 16, and the support circuit 14 is integrally formed on the driver IC 20. In other embodiments a portion or all of the support circuit 44 may also be formed on the LCD panel 16. The illustrated transistor-degradation circuit 42 may include a high-duty cycle transistor 46 and a low-duty cycle transistor 48. The sources of the transistors 46 and 48 may be connected to the pull-down voltage source 38, and the drains of the transistors 46 and 48 may be connected to a load circuit 50. The load circuit 50 may be generally similar or identical to the load circuit used to elevate the voltage of the gate lines 30 (FIG. 1). The transistors 46 and 48 may be similar or generally identical to the gate-line transistors 26 (FIG. 1), and in some embodiments, may be formed generally simultaneously with the gate-line transistors 26 (FIG. 1) using the same photolithography masks, depositions steps, and etches. As a result, the transistors 46 and 48, when turned on, may experience similar or generally identical current densities and electric field intensities as the gate-line transistors 26 (FIG. 1).

In the illustrated embodiment, the support circuit 44 may include a comparator 52 and a controller 54. The inverting input terminal of the comparator 52 may be connected to the drain of the low-duty cycle transistor 48, and the non-inverting input terminal of the comparator 52 may be connected to the drain of the high-duty cycle transistor 46. The comparator 52 may receive a control signal 56 from the controller 54 that directs the comparator 52 to compare the voltage of its inputs. An output signal 58 may indicate the results of the comparison, e.g., if $V_{LOW\text{-}DS\ DRAIN}$ is greater than $V_{HIGH\text{-}DS\ DRAIN}$. In some embodiments, the output signal 58 is stored in a register 60 on the driver IC 20 or elsewhere in the LCD 10 (FIG. 1) or in the electronic device including the LCD 10. In other embodiments, the output signal 58 may not be stored in memory, and immediate action may be taken based on the output signal 58, such as executing one or more of the processes described below with reference to FIGS. 8 and 9. The controller 54 may receive a signal 61 from a main logic board 62 that directs the controller 54 to test the transistors 46 and 48 for degradation. The main logic board 62 may include a processor that controls the general operation of the electronic device including the LCD 10 (FIG. 1). In some embodiments, the output signal 58 may be routed to the main logic board 62, and the results of a comparison may be stored by or acted upon by the main logic board 62. The illustrated controller 54 may connect to the gates of the transistors 46 and 48 through a $V_{HIGH\text{-}DS\ GATE}$ signal and a $V_{LOW\text{-}DS\ GATE}$ signal.

In operation, the transistor degradation circuit 42 and the support circuit 44 may determine whether the threshold voltage of the gate-line transistors 26 (FIG. 1) is likely to have changed. During the operation of the LCD 10, the controller 54 may maintain the transistor 46 in a conductive state by holding $V_{HIGH\text{-}DS\ GATE}$ high a substantial portion of the time, e.g., generally equal to or greater than 99% of the time the LCD 10 is operating. In some embodiments, the controller 54 may maintain the transistor 46 in a conductive state for an amount of time that is generally equal to the amount of time that a typical gate-line transistor 26 (FIG. 1) is turned on, or the controller 54 may hold $V_{HIGH\text{-}DS\ GATE}$ high all or substantially all of the time. As a result, the high-duty cycle transistor 46 is believed to age at a rate that is similar to the rate at which the gate-line transistors 26 age. Thus, when the threshold voltage of the high-duty cycle transistor 46 changes, it may be likely that the threshold voltage of the gate-line transistors 26 has also changed by a similar amount. To provide a reference for comparison, the low-duty cycle transistor 48 may be left in a non-conductive state for substantially all of the time in which the LCD 10 is operating, except during one of the subsequently described tests. Thus, the low-duty cycle transistor 48 may have a threshold voltage that is generally equal to the threshold voltage of a relatively new gate-line transistor 26 (FIG. 1).

At different points during the life of the LCD 10, e.g., periodically or during a start-up or shut-down sequence, the main logic board 62 may output the degradation-check signal 61 to the controller 54 to initiate a comparison of the transistors 46 and 48. In response to the comparison-check signal 61, the controller 54 may turn off both of the transistors 46 and 48 and, then, gradually elevate their gate voltages $V_{HIGH\text{-}DS\ GATE}$ and $V_{LOW\text{-}DS\ GATE}$ until at least one of the transistors 46 or 48 becomes conductive, e.g., exceeds its threshold voltage. $V_{HIGH\text{-}DS\ GATE}$ and $V_{LOW\text{-}DS\ GATE}$ may be generally equal during the ramp-up in voltage, and they may be adjusted by a generally regular increment at generally regular intervals, e.g., in a step pattern with 4, 16, 32, 64, 128, 256, or more steps. In some embodiments, the controller 54 may output analog signals that change $V_{HIGH\text{-}DS\ GATE}$ and $V_{LOW\text{-}DS\ GATE}$ relatively smoothly, e.g., at a generally constant rate of increase. At relatively low voltages, both transistors 46 and the 48 may experience gate voltages $V_{HIGH\text{-}DS\ GATE}$ and $V_{LOW\text{-}DS\ GATE}$ below their threshold gate voltage, and both inputs to the comparator 52 may be generally equal, e.g., generally equal to the voltage asserted by the load circuit 50. If the transistor 46 has aged, and its threshold gate voltage has increased, at some point during the increase of $V_{HIGH\text{-}DS\ GATE}$ and $V_{LOW\text{-}DS\ GATE}$, the low-duty cycle transistor 48 may turn on and the high-duty cycle transistor 46 may remain off. As a result, the low duty cycle drain may be pulled down by the pull-down voltage source 38 and the inputs to the comparator 52 may be different. When the inputs to the comparator 52 become different, the comparator 52 may adjust the output signal 58 to indicate this difference, and the register 60 may store the changed value. In some embodiments, the register 60 may store a value indicative of the amount of change in $V_{HIGH\text{-}DS\ GATE}$ and $V_{LOW\text{-}DS\ GATE}$ before the output 58 changes, e.g., a number of clock cycles between transmission of the degradation-check signal 61 and the change in the output 58. In other embodiments, the transistors 46 and 48 may be initially turned on during a test, and the $V_{HIGH\text{-}DS\ GATE}$ and $V_{LOW\text{-}DS\ GATE}$ may be gradually decreased until the transistors turn off.

In certain embodiments, the controller 54 may then continue to increase the gate voltages $V_{HIGH\text{-}DS\ GATE}$ and $V_{LOW\text{-}DS\ GATE}$ until the high-duty cycle transistor 46 turns on and the inputs to the comparator 52 are equal again. When the inputs to the comparator 52 return to generally the same voltage, the output signal 58 may change, and this change may be stored in the register 60. In some embodiments, a value indicative of the difference in the amount of time or number of voltage increments of $V_{HIGH\text{-}DS\ GATE}$ and $V_{LOW\text{-}DS\ GATE}$ between when the low-duty cycle transistor 48 turns on and when the high-duty cycle transistor 46 turns on may be stored, e.g., a number of clock cycles between the first change in the output signal 58 and the second change in the output signal 58.

The difference in threshold voltage may be generally indicative of the amount of ageing of the high-duty cycle transistor 46 and the amount of ageing of the gate-line transistors 26 (FIG. 1). If the high-duty cycle transistor 46 has not substantially aged, and still generally behaves like the low-duty cycle transistor 48, the transistors 48 and 46 may turn on at generally the same time, and the comparator 52 may output a signal indicative of no difference or a relatively small difference.

Figure 3:
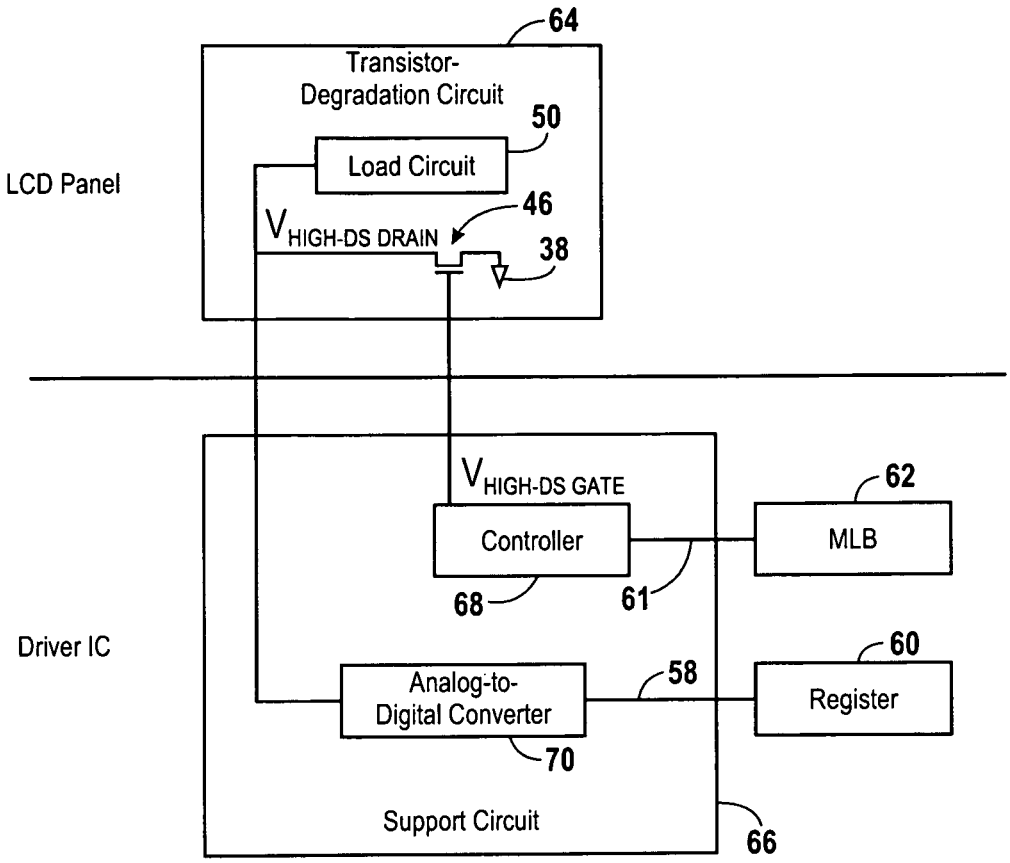
FIG. 3 illustrates a second example of a transistor-degradation circuit in accordance with an embodiment of the present technique.

FIG. 3 illustrates another embodiment of a transistor-degradation circuit 64 and a support circuit 66, which are examples of the transistor-degradation circuit 12 and support circuit 14 illustrated by FIG. 1. In this embodiment, the transistor-degradation circuit 54 includes the load circuit 50, the high-duty cycle transistor 46, and the pull-down voltage source 38. The illustrated support circuit 66 may include a controller 68 and an analog-to-digital converter 70. The controller 68 may keep the high-duty cycle transistor 46 in a conductive state for a substantial portion of time in which the LCD 10 (FIG. 1) is operating, e.g., generally equal to or greater than 99%, of the time that the LCD 10 (FIG. 1) is operating, by elevating $V_{HIGH\text{-}DS\ GATE}$ to age the high-duty cycle transistor 46.

In response to a degradation-check signal 61 from the main logic board 62, the controller 68 may turn off the transistor 46 and, then, test the gate voltage threshold of the high-duty cycle transistor 46 by gradually increasing $V_{HIGH\text{-}DS\ GATE}$ in a manner similar to that described above with reference to FIG. 2. During the increase in $V_{HIGH\text{-}DS\ GATE}$, the analog-to-digital converter 70 may produce an output signal 58 that is generally equal to a logic value of 1 until the high-duty cycle transistor 46 turns on and $V_{HIGH\text{-}DS\ DRAIN}$ is pulled down by the pull-down voltage source 38, at which point the analog-to-digital converter 70 may produce an output signal 58 corresponding to a logic value of 0. A value indicative of the threshold voltage of the high-duty cycle transistor 46 may be stored in memory. In some embodiments, the threshold voltage of the high-duty cycle transistor 46 may be measured at the beginning of the life of the LCD 10 (FIG. 1), and this value may be compared to subsequent measurements over the life of the LCD 10 (FIG. 1) to determine a change in the threshold voltage.

Figure 4:
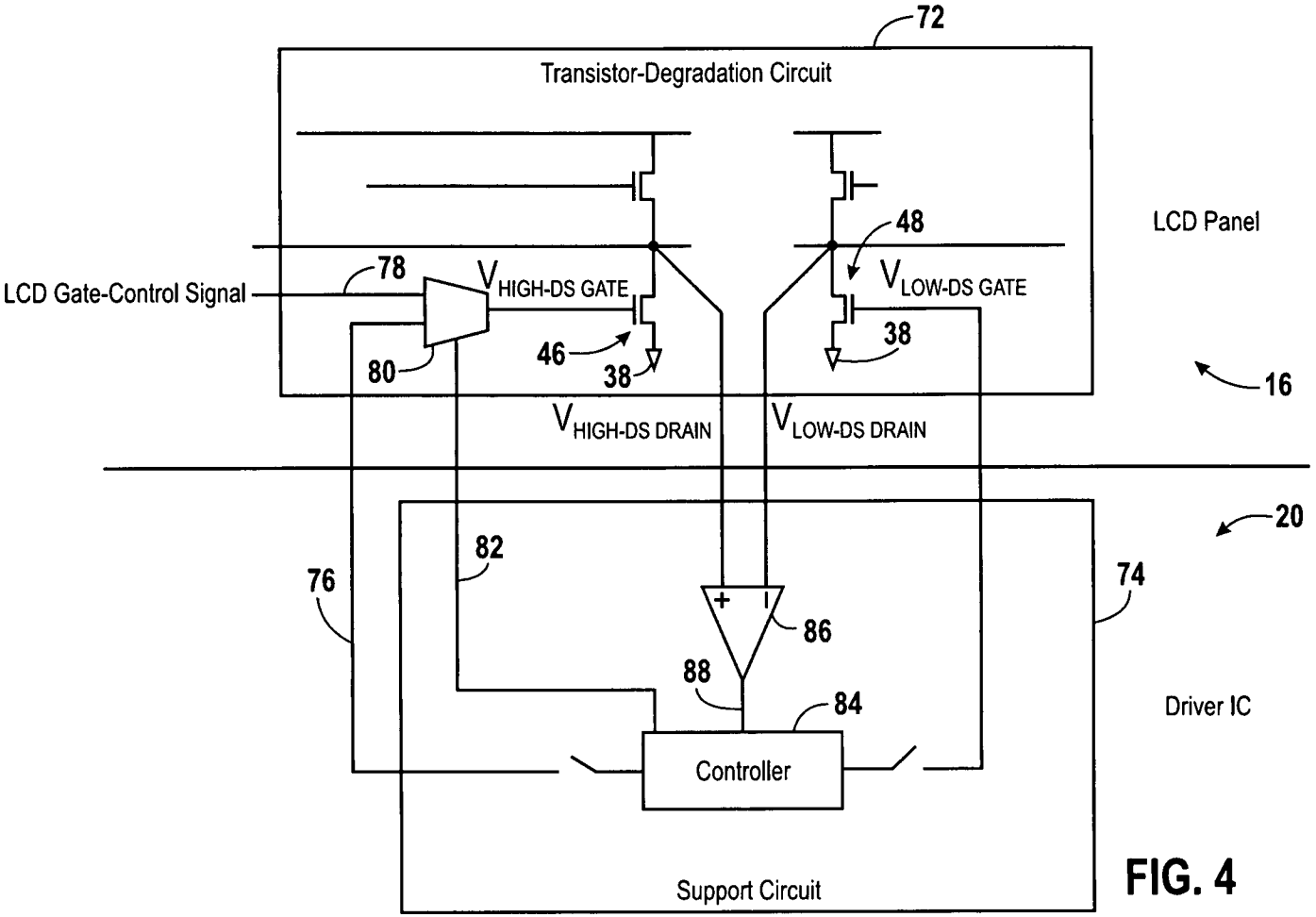
FIG. 4 illustrates a third example of a transistor-degradation circuit in accordance with an embodiment of the present technique.

FIG. 4 illustrates another transistor-degradation circuit 72 and support circuit 74, which are examples of the transistor-degradation circuit 12 and the support circuit 14 illustrated by FIG. 1. In this embodiment, the gate of the high-duty cycle transistor 46 is selectively coupled to either a test gate-control signal 76 or an LCD gate-control signal 78 by a multiplexer 80 or other switching device. The multiplexer 80 may switch between the signals 76 and 78 in response to a control signal 82. The LCD gate-control signal 78 may be a signal that controls one of the gate-line transistors 26 (FIG. 1), such that, when the LCD gate-control signal 78 is selected by the multiplexer 80, and the high-duty cycle transistor 46 turns on and remains on generally as frequently as one of the gate-line transistors 26 (FIG. 1). In some embodiments, the LCD gate-control signal 78 may be transmitted by the driver IC 20.

In the present embodiment, the support circuit 74 may include a controller 84 and a comparator 86. The controller 84 may output the test gate-controls signal 76 and the control signal 82 to the multiplexer 80. The controller 84 may also output the $V_{LOW\text{-}DS\ GATE}$ signal to the low-duty cycle transistor 48. The controller 84 may receive an output signal 88 from the comparator 86. The inputs of the comparator 86 may be connected to the drains of the high-duty cycle transistor 46 and the low-duty cycle transistor 48.

The controller 84 may have two or more modes of operation: a transistor-ageing mode and a transistor-degradation test mode. In the transistor-ageing mode, the controller 84 may signal the multiplexer 80 with the control signal 82 to select the LCD gate-control signal 78. The high-duty cycle transistor 46 may turn on generally as frequently as the gate-line transistors 26 (FIG. 1), ageing the high-duty cycle transistor 46 at generally the same rate as the gate-line transistors 26 (FIG. 1). During the ageing mode, the controller 84 may maintain the low-duty cycle transistor 48 in an off state, resulting in relatively little ageing of the low-duty cycle transistor 48.

In the transistor-degradation test mode, the controller 84 may signal the multiplexer 80 with the control signal 82 to select the test gate-control signal 76, thereby asserting control over $V_{HIGH\text{-}DS\ GATE}$. During a test, the controller 84 may incrementally and periodically increase $V_{HIGH\text{-}DS\ GATE}$ and $V_{LOW\text{-}DS\ GATE}$ from a voltage that turns off both of the transistors 46 and 48 to a voltage that turns on one or both the transistors 46 and 48. As the controller 84 increases $V_{HIGH\text{-}DS\ GATE}$ and $V_{LOW\text{-}DS\ GATE}$, the comparator 86 may compare the $V_{HIGH\text{-}DS\ DRAIN}$ to $V_{LOW\text{-}DS\ DRAIN}$ and adjust the output signal 88 based on the comparison, e.g., output a logic value of 0 if $V_{LOW\text{-}DS\ DRAIN}$ is less than $V_{HIGH\text{-}DS\ DRAIN}$ and output a logic value of 1 if $V_{LOW\text{-}DS\ DRAIN}$ is greater than $V_{HIGH\text{-}DS\ DRAIN}$. When the threshold voltage of one of the transistors 46 or 48 is exceeded, the voltages at the input of the comparator 86 may become different, and the controller 84 may detect a change in the output 88. In some embodiments, the controller 84 may continue to elevate $V_{HIGH\text{-}DS\ GATE}$ and $V_{LOW\text{-}DS\ GATE}$ until both of the transistors 46 and 48 turn on, and the inputs to the comparator 86 match again. The value of $V_{HIGH\text{-}DS\ GATE}$ and $V_{LOW\text{-}DS\ GATE}$ that cause the output signal 88 to indicate a difference in the inputs and the value of $V_{HIGH\text{-}DS\ GATE}$ and $V_{LOW\text{-}DS\ GATE}$ that cause the output signal 88 to indicate that the inputs are the same again may be stored in memory or transmitted to the main logic board 62 or the register 60 (FIG. 2).

Figure 5:
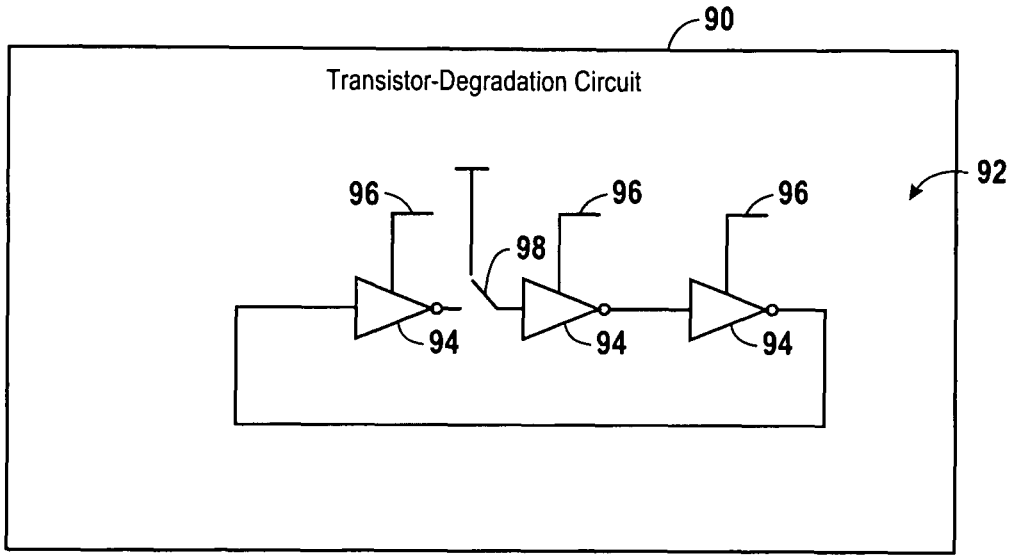
FIG. 5 illustrates a fourth example of a transistor-degradation circuit in accordance with an embodiment of the present technique.

FIG. 5 illustrates another embodiment of a transistor-degradation circuit 90, which is an example of the transistor-degradation circuit 12 illustrated by FIG. 1. In this embodiment, the transistor-degradation circuit 90 includes a ring oscillator 92 having a plurality of inverters 94 with their inputs coupled to the output of an adjacent inverter 94. The illustrated embodiment includes three inverters 94, but other embodiments may include substantially more, e.g., 100 or more. Control signals 96 may set the initial conditions of the transistor-degradation circuit 90, e.g., the starting outputs of the inverters 94, and a control switch 98 may initiate operation of the ring oscillator 92. In some embodiments, the control signals 96 may be set such that one of the transistors in the inverters 94 are turned on a substantial portion of the time during which the LCD 10 (FIG. 1) is operating to age these transistors. The inverters 94 may be formed from transistors disposed on the LCD panel 16 (FIG. 1), and inverters' transistors may be generally similar or identical to the gate-line transistors 26 (FIG. 1). In some embodiments, the transistor-degradation circuit 90 includes as many or approximately as many inverters 94 as there are gate-line transistors 26 (FIG. 1).

In operation, the inverters 94 may be set to an initial state, and the output value of each of the inverters 94 may be propagated around the ring oscillator 92 to age the transistors in the ring oscillator 92. For example, in some embodiments, all of the inverters 94 except one may be initially set to output a value of 0, and the value of 1 may be propagated in a loop around the ring oscillator 92. In another example, all or substantially all of the inverters 94 may be set to output an initial value of 1, and the value 0 may be propagated around the ring oscillator 92 to age the transistors in the ring oscillator 92.

During a test, the voltage of the power supply of the ring oscillator 92 may be gradually decreased until the ring oscillator 92 ceases to operate. For instance, the voltage supplied to each of the inverters 94 may be incrementally and periodically stepped down until the value of 1 or 0 stops cycling. The voltage at which the ring oscillator 92 stops operating may generally correspond to the threshold voltage of the gate-line transistors 26 (FIG. 1). In some embodiments, this threshold voltage may be transmitted to the main logic board 62 or stored in the register 60 (FIG. 2).

Figure 6:
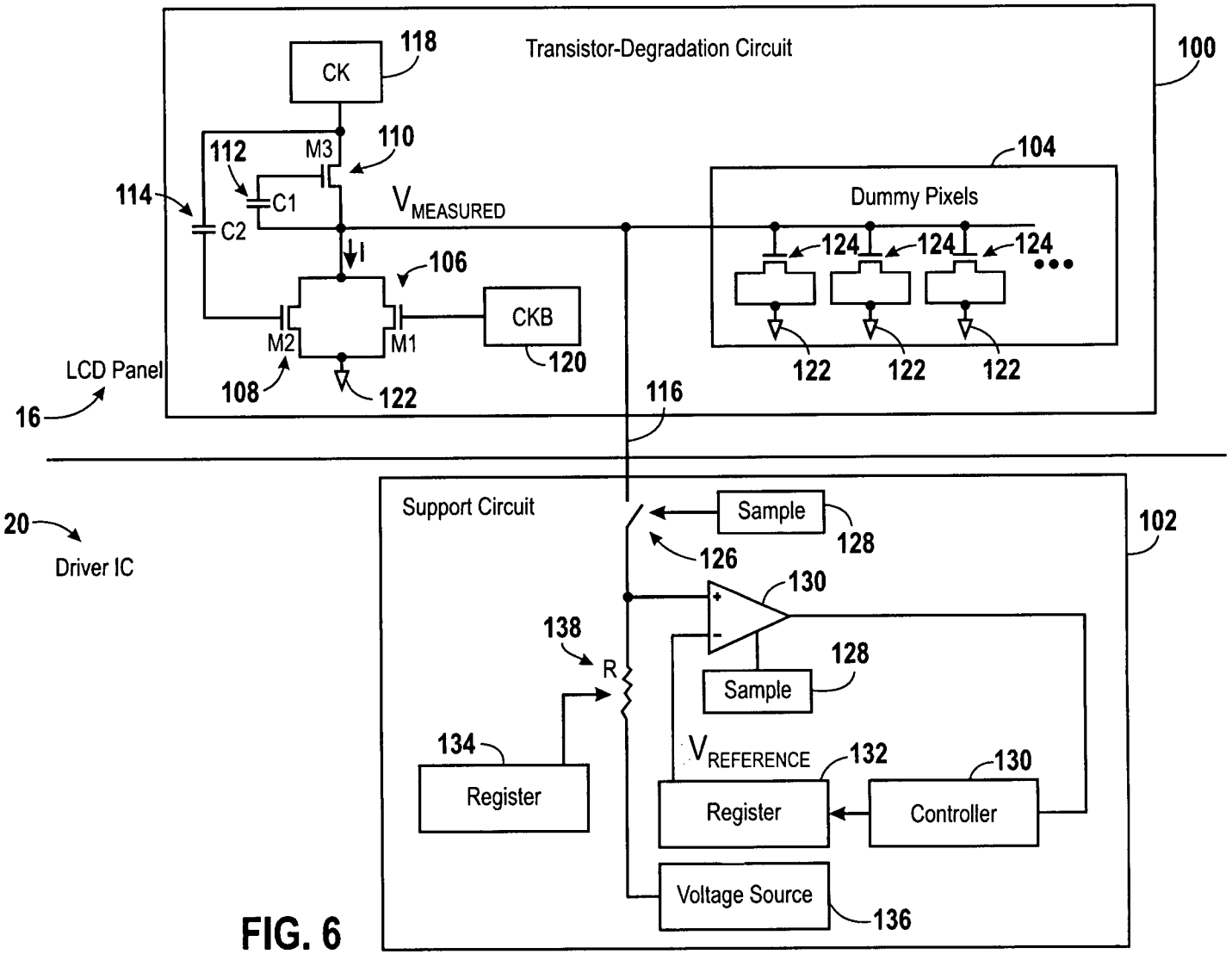
FIG. 6 illustrates a fifth example of a transistor-degradation circuit in accordance with an embodiment of the present technique.

FIG. 6 illustrates another example of a transistor-degradation circuit 100 and a support circuit 102. The illustrated transistor-degradation circuit 100 and support circuit 102 may operate with relatively few connections between the LCD panel 16 and the driver IC 20, e.g., 1, 2, or 3 connections between of the transistor-degradation circuit 100 and the support circuit 102.

In this embodiment, the transistor-degradation circuit 100 may include an array of dummy pixels 104, three transistors 106, 108, and 110 (M1, M2, and M3), and two capacitors 112 and 114 (C1 and C2). The transistor-degradation circuit 100 may connect to the support circuit 102 through a single output signal path 116 or, in other embodiments, through multiple output signal paths, e.g., fewer than two or three output signal paths. The transistor-degradation circuit 100 may also connect to a clock signal 118, an inverted clock signal 120, and a pull-down voltage source 122.

The dummy pixels 104 may include a plurality of transistors 124 having gates coupled to the output signal path 116 and sources and drains connected to the pull-down voltage source 122. In some embodiments, the number of transistors 124 among the dummy pixels 104 may be about equal to the number of rows or columns of sub-pixels in the LCD panel 16. The gates of the transistors 124 may be connected to a load circuit (M1, M2 and M3) to pull the gate line up or down. The dummy pixels 104 replicate the load seen by the actual gate-line transistor 26. M1 and M2 are essentially the same as the gate-line transistor 26, and thus the dummy pixels 104 allow the transistor degradation circuit 100 to experience the same environment as the gate-line transistors 26.

One of the terminals (e.g., the source or the drain) of each of the transistors 106, 108, and 110 may be connected to the output signal path 116. The gate of the transistor 106 may be connected to the inverted clock signal 120, and the gate of the transistor 108 may receive the clock signal 118 through the capacitor 114. The gate of the transistor 110 may be in communication with the output signal path 116 across the plates of the capacitor 112. Alternatively, the capacitors 112 and 114 may be omitted. In accordance with this embodiment, the gates of the transistors 106, 108 and 110, and the drain of the transistor 110, may be connected to the same gate drive control signals as the normal gate drive circuits. As will be appreciated, the transistors 106, 108 and 110 are the subset of the transistors used to drive the non-dummy gate lines that are of interest due to aging. This embodiment replicates a normal, non-dummy row, normal gate driver circuit, normal gate line (but connected to dummy pixels), and normal control signals.

The support circuit 102 may include a switch 126 that is responsive to a sample signal 128, a comparator 130 that is also responsive to the sample signal 128, a counter 131, registers 132 and 134, a voltage source 136, and a variable resistor 138. The switch 126 may be configured to selectively open and close the output signal path 116. The non-inverting input of the comparator 130 may be connected to the output signal path 116 between the switch 126 and the variable resistor 138, and the inverting input of the comparator 130 may receive a reference voltage $V_{REFERENCE}$ from the register 132. The output of the comparator 130 may be connected to the counter 131, which may output a count signal to the register 132. The other register 134 may be coupled to the variable resistor 138 and may be configured to vary the resistance of the variable resistor 138 in accordance with stored values. The voltage source 136 may be connected to a terminal of the variable resistor 138 that is opposite the terminal of the variable resistor 138 connected to the output signal path 116.

In operation, the transistors 106, 108, and 110 may age as the LCD panel 16 operates. The clock signal 118 and the inverted clock signal 120 may turn the transistors 106 and 108, respectively, on and off. The transistor 110 may be turned on and off as the transistors 124 in the dummy pixels 104 are turned off and on.

The degree to which the transistors 106, 108, and 110 have aged may be determined by measuring the on resistance of the transistors 106, 108 and 110 and using measurements as an indication of threshold voltage. When a measurement is taken, a resistor divider is formed between one of the transistors 106, 108 and 110, and the variable resistor 138. As the on resistance changes from aging, a different value of the variable resistor 138 will cause the comparator to. The change in resistance may indicate the degree to which the transistors 106, 108, and 110 have aged. A larger change may correspond with more aging.

The transistors 106, 108, and 110 may each be measured at different times relative to one another. As explained below with reference to FIGS. 7A-7C, each of the transistors 106, 108, and 110 may output a signal on the output signal path 116 that is indicative of its threshold voltage. Which of the transistors 106, 108, or 110 outputs the signal may depend on the phase of the clock signal 118, the phase of the inverted clock signal 120, and the phase of the voltage of the output signal path 116. The threshold voltage of each of the transistors 106, 108, and 110 may be measured in the support circuit 102 by incrementally increasing the reference voltage $V_{REFERENCE}$ until the comparator 130 indicates that the reference voltage $V_{REFERENCE}$ is greater than the output signal path 116 voltage. While measuring threshold voltages, the counter 131 may increment or decrement a count, and the register 132 may increase or decrease $V_{REFERENCE}$ according to this count and store the final count. The final count may be compared with previous counts or subsequent counts to determine the degree to which the transistors 106, 108, and 110 have aged. Alternatively, the reference voltage $V_{REFERENCE}$ is and the variable resistor 138 may both be adjusted to increase the measurement range or otherwise enhance the measurement capability.

Figures 7A, 7B, 7C:
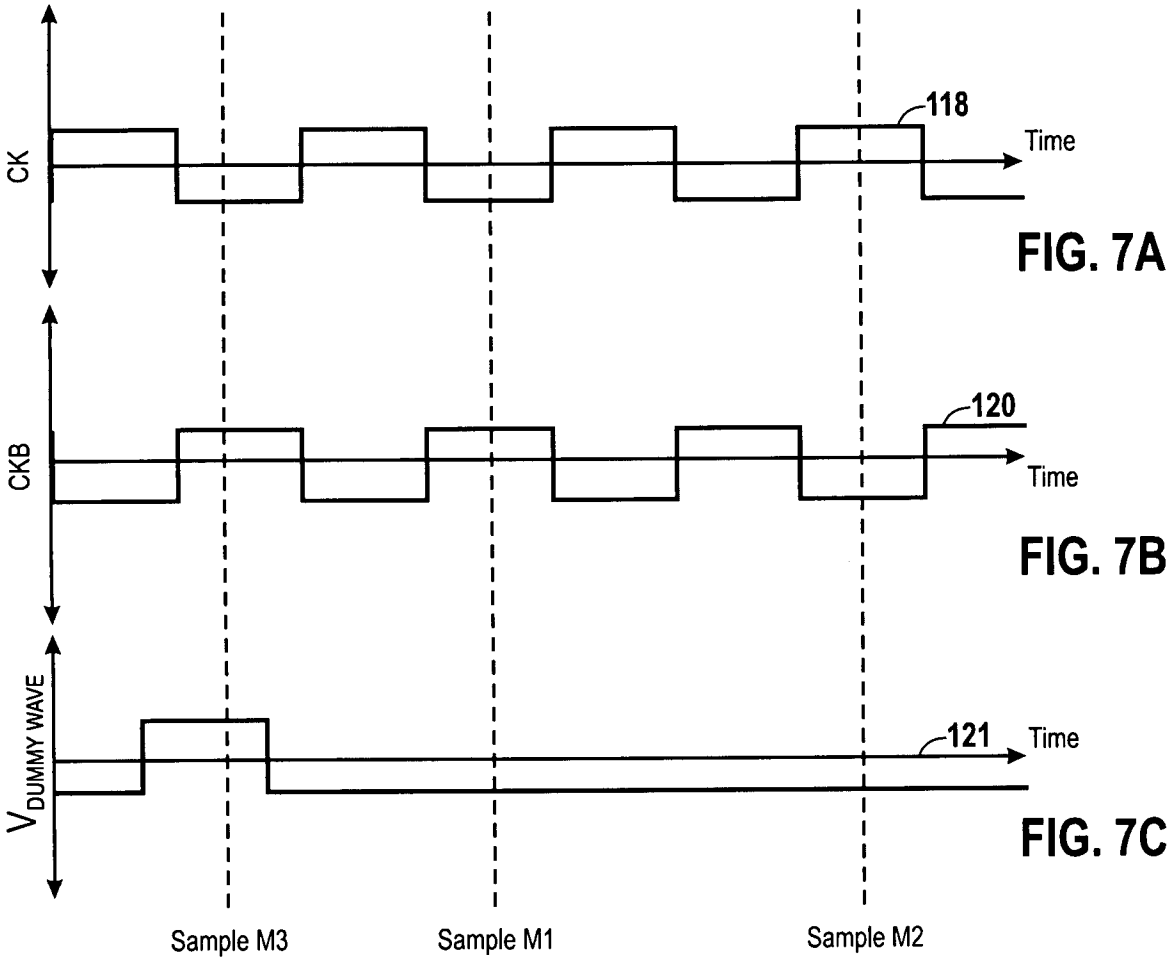
FIGS. 7A-7C illustrate examples of voltage traces in the transistor-degradation circuit of FIG. 6.

FIGS. 7A-7C illustrate timing diagrams that depict when each of the transistors 106, 108, and 110 may be measured. FIG. 7A illustrates the clock signal 118 (CK) with respect to time, FIG. 7B illustrates the inverted clock signal 120 (CBK) with respect to time, and FIG. 7C illustrates the dummy wave signal 121 ($V_{DUMMY\ WAVE}$) with respect to time. The time axes of each of these figures may be synchronized, such that features that are vertically aligned occur at generally the same time. During operation, transistors 106 and 108 (M1 and M2) have approximately 50% duty cycle. One of the transistors 106 and 108 is almost always on. Thus, only when the transistor 110 (M3) is on are M2 and M1 off. As illustrated, that is the case when the gate line ($V_{MEASURED}$ of FIG. 6) is pulled high. M3 has a very low duty cycle, so it can be used as a reference for an almost unaged transistor, while M1 and M2 age much more.

As illustrated in FIGS. 7A-7C, the transistor 106 (M1) is measured when CKB is high, and the transistor 108 is measured when CK (and the other control signals in the gate driver circuit) pulls the gate of the transistor 108 (M2) high. The dummy wave signal $V_{DUMMY\ WAVE}$ may be at a low voltage except for a single-clock cycle step-up in voltage during which the transistor 110 (M3) is measured. The dummy wave may have a period that is generally equal to the number of rows or columns of sub-pixels in the LCD panel 16, e.g., about 480 clock cycles. The dummy wave may be phase shifted relative to the clock signal by about one half clock cycle. The dummy wave $V_{DUMMY\ WAVE}$ may be logic low for substantially its entire period except for about one clock cycle, two clock cycles, or fewer than five clock cycles, for example.

The transistor 106 may be measured when the clock signal cycles low, the inverted clock signal cycles high, and the dummy wave $V_{DUMMY\ WAVE}$ cycles low. As illustrated by FIG. 6, during this measurement, current may flow from the voltage source 136, through the output signal path 116, and between the source and drain of the transistor 106 to the pull-down voltage source 122. The amount of current flowing may depend, in part, on the threshold voltage of the transistor 106, which may also affect the voltage of the output signal path 116. This voltage may be sensed by the comparator 130, by comparing the voltage of the output signal path 116 to $V_{REFERENCE}$. $V_{REFERENCE}$ may be varied until it exceeds the voltage of the output signal path. $V_{REFERENCE}$ may be varied during a single clock cycle, or it may be once or more than once during each clock cycle until it is greater than the voltage of the output signal path. As will be appreciated, the clock cycle of the support circuit may be different that the clock cycle CK. For example, the clock cycle may have a higher frequency than the clock signal CK. The voltage of $V_{REFERENCE}$ that is greater than the voltage of the output signal path 116 and the corresponding count of the counter 131 may be indicative of the threshold voltage of the transistor 106.

Similarly, as illustrated by FIGS. 7A-7C, the threshold voltage of the transistor 108 may be measured when the clock signal is high, the inverted clock signal is low, and the dummy wave is low. As with the previous measurement, current may flow between the voltage source 136 (FIG. 6) and the pull-down voltage source 122, through the transistor 108. As current flows, the threshold voltage of the transistor 108 may correspond with the voltage of the output signal path 116, which may be measured by varying $V_{REFERENCE}$ until the output of the comparator 130 changes. Other embodiments may employ a dummy wave that is inverted with respect to the dummy wave illustrated by FIG. 7C.

As illustrated by FIG. 7C, threshold voltage of the transistor 110 may be measured when the clock signal is low, the inverted clock signal is high, and $V_{DUMMY\ WAVE}$ is high. As discussed above, the transistor 110 (M3) is measured when CK is high, the gate of M3 is pulled high by other devices in the gate driver circuit, and Vmeasured is pulled high. CKB is low. Current flows from CK (high), through M3 (pulling Vmeasured high), through the variable resistor 138, and to the voltage source 136, which is low for this measurement. Conversely, the voltage source 136 is high when M1 and M2 are measured.

Figure 8:
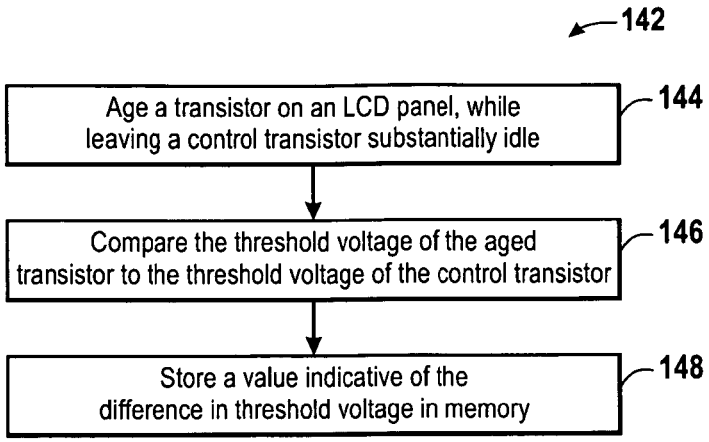
FIG. 8 illustrates an example of a process for monitoring an LCD in accordance with an embodiment of the present technique.

FIG. 8 illustrates an embodiment of a process for monitoring an LCD 142. The process 142 may begin with ageing a transistor on an LCD panel, while leaving a control transistor substantially idle, as illustrated by block 144. This may include ageing the transistor by turning the transistor on, heating the transistor, or otherwise stressing the transistor during a substantial portion of the time in which to the LCD panel is in operation.

Next, the threshold voltage of the aged transistor may be compared to the threshold voltage of the control transistor, as illustrated by block 146. Comparing threshold voltages may include applying a voltage across the source and the drain of both the aged transistor and the control transistor and incrementally and periodically raising or lowering the voltage of the gates of the aged transistor and the control transistor until one of the transistors conducts an amount of current greater than or less than a current threshold. In some embodiments, comparing the threshold voltage may include determining the difference in threshold voltage or determining whether the difference in threshold voltage is greater than some value. Some embodiments may not include a control transistor (which is not to suggest that any other feature described herein may not also be omitted), and the transistor being aged may be measured before and after ageing to quantify the effect of ageing.

Next, a value indicative of the difference in threshold voltage may be stored in memory, as illustrated by block 148. The value indicative of the difference in threshold voltage may be a digital, e.g., binary, value or an analog value. For instance, the value may be a 0 if the difference in threshold voltage is less than some value and a 1 if the difference in threshold voltage is greater than the value. In another example, the value indicative of the difference in threshold voltage may be generally proportional to the difference in threshold voltage. In some embodiments, a value indicative of the threshold voltage of the aged transistor may stored in memory, e.g., a binary value indicating whether the threshold voltage of the aged transistor is greater than or less than some quantity, or a value proportional to the threshold voltage of the aged transistor. The value may be stored in memory disposed on an integrated circuit or a printed circuit board coupled to the LCD panel, for example in a register, or cache memory.

Figure 9:
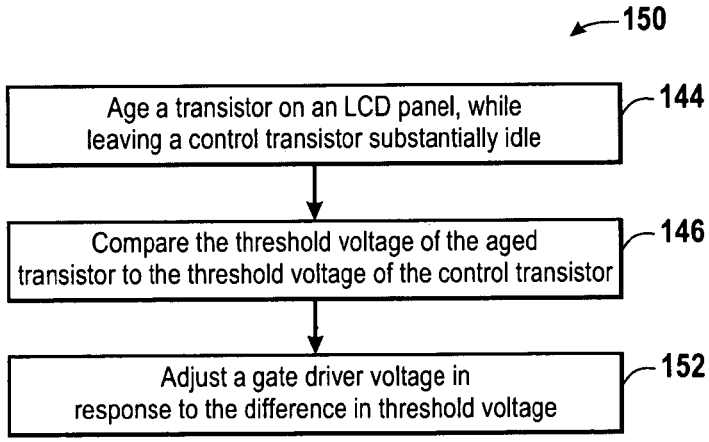
FIG. 9 illustrates an example of a process for controlling an LCD in accordance with an embodiment of the present technique.

FIG. 9 illustrates an embodiment of a process for controlling an LCD 150. The illustrated process 150 may begin with the two previously-described steps labeled with block numbers 144 and 146: ageing the transistor on the LCD panel, while leaving the control transistor substantially idle; and comparing the threshold voltage of the aged transistor to the threshold voltage of the control transistor. Next, a gate driver voltage may be adjusted in response to the difference in threshold voltage, as illustrated by block 152. In some embodiments, this may include increasing the gate driver voltage to compensate for an increase in the threshold voltage of the gate-line transistors. In other embodiments, other properties may be adjusted. For instance, an auxiliary set of gate-line transistors may be enabled, and a currently operative set of gate-line transistors may be disabled to rejuvenate the LCD panel.

Figure 10:
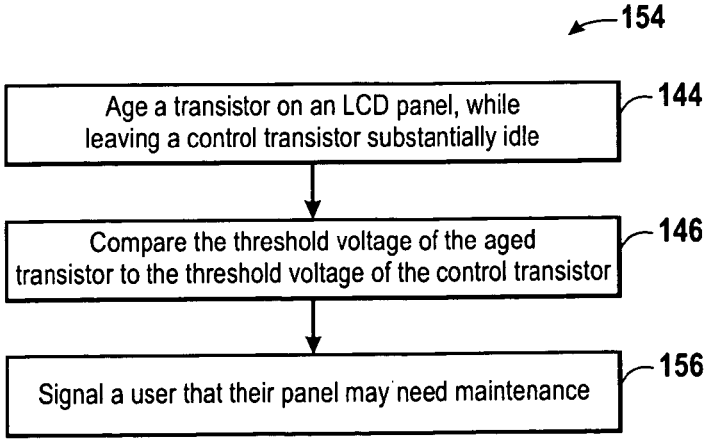
FIG. 10 illustrates an example of a process for displaying information about an LCD in accordance with an embodiment of the present technique.

FIG. 10 illustrates an embodiment of a process for displaying information about an LCD 154. This process may begin with the previously described steps illustrated by blocks 144 and 146 of ageing the transistor and comparing the threshold voltage of the aged transistor to the threshold voltage of the control transistor. The process 154 may include signaling a user that their panel may need maintenance, as illustrated by block 156. Signaling the user may include displaying a message on the LCD panel that indicates the panel may need to be replaced or serviced. In some embodiments, the result of the comparison performed in step 156 may be transmitted to a processor, and software executed by that processor may evaluate whether the difference in threshold voltage warrants maintenance.

Figure 11:
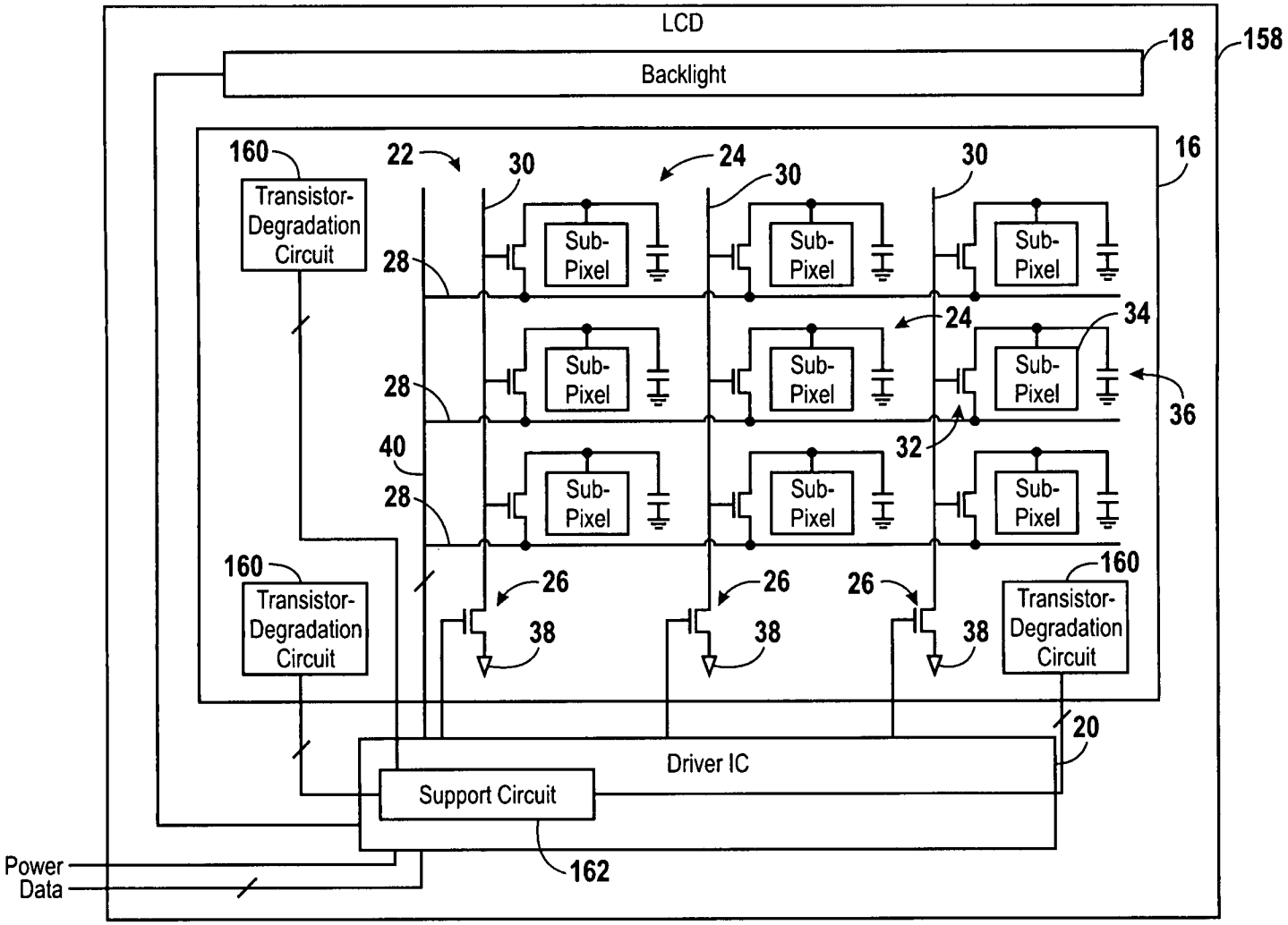
FIG. 11 illustrates a second example of an LCD in accordance with an embodiment of the present technique.

FIG. 11 illustrates another example of an LCD 158. The illustrated LCD 158 may be generally similar to the LCD 10 illustrated by FIG. 1, except, in this embodiment, the LCD 158 includes a plurality of transistor-degradation circuits 160 and a support circuit 162 configured to communicate with the plurality of transistor-degradation circuits 160. The illustrated embodiment includes three transistor-degradation circuits 160, but other embodiments may include more or fewer transistor-degradation circuits 160. In some embodiments, the transistor-degradation circuits 160 may be positioned near portions of the LCD panel 158 believed to have relatively high temperatures compared to the rest of the LCD panel 158 or near areas of the LCD panel 158 in which the manufacturing process used to produce the LCD panel 158 is known to form less robust transistors, e.g., areas in which process variations affect transistor dimensions. The support circuit 162 may be configured to output signals indicative of transistor degradation in each of the transistor-degradation circuits 160 or a signal that indicates when a certain number, e.g., one, or substantially all, of the transistor-degradation circuits 160 output a signal exceeding some threshold.

Figure 12:
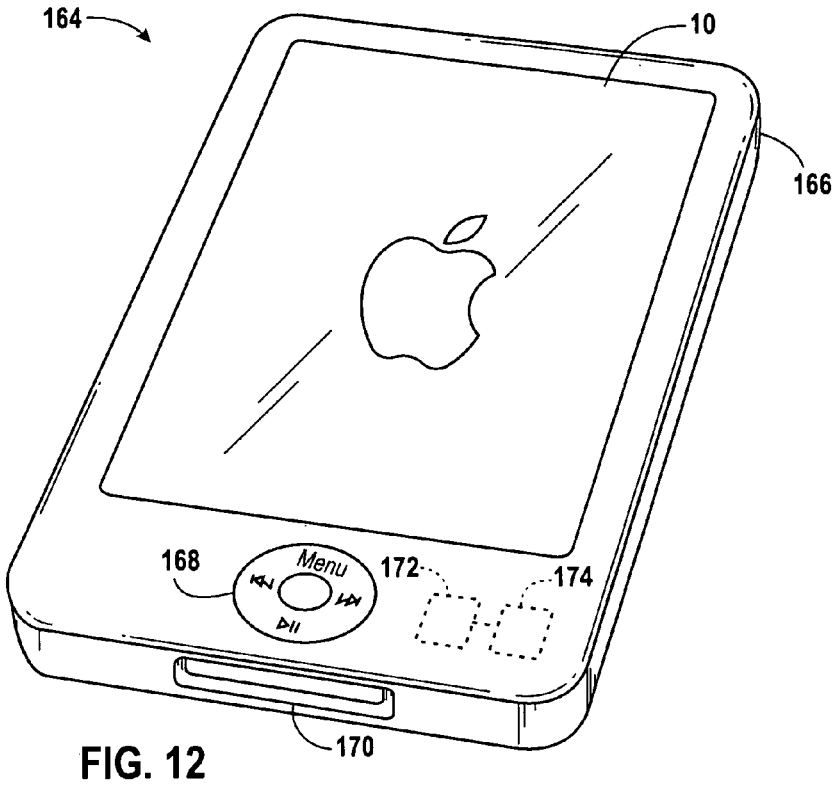
FIGS. 12 and 13 illustrate an example of an electronic device including the LCD of FIG. 1 or 2 in accordance with an embodiment of the present technique.

FIG. 12 illustrates an example of an electronic device 164 that may include the LCD 10 of FIG. 1 or the LCD 158 of FIG. 11 or may execute one or more of the processes illustrated by FIGS. 8-10. As will be appreciated, embodiments of the invention may be employed in any electronic device that includes an LCD, such as laptops, desktops, and portable devices. The electronic device 164 may be a portable media player, such as a portable digital music player or a portable digital video player. The electronic device 164 may include the LCD 10, a chassis 166, a user interface 168, a communication and power port 170, a processor 172, and memory 174. In addition to the features of the LCD 10 or 158 described above, the LCD 10 may include a layer responsive to a contact from, or close proximity of, a finger or a stylus, such as a digitizer. In some embodiments, this layer may be responsive to multiple areas of contact, e.g., a multi-touch digitizer. The chassis 166 may generally shield the interior of the electronic device 164 from electromagnetic noise, moisture, and mechanical contact. The user interface 168 may be a generally circular user interface that is responsive to contact from a finger. The processor 172 and the memory 174 may be disposed on the main logic board 62 (FIG. 2) described above. In some embodiments, the processor 172 is configured to output the degradation-check signal 61 (FIG. 1), and execute one or more of the processes described above with reference to FIGS. 8-10. The memory 174 may include a variety of types of memory, such as non-volatile flash memory or a hard drive. In some embodiments, the memory 174 may store music or video data, such as music or video data encoded in Advanced Audio Coding (AAC) or other compression format, such as MP3, MP4, OGG, WAV, FLAC, or Apple Lossless format. The memory 174 may also store an operating system for the electronic device 164.

Figure 13:
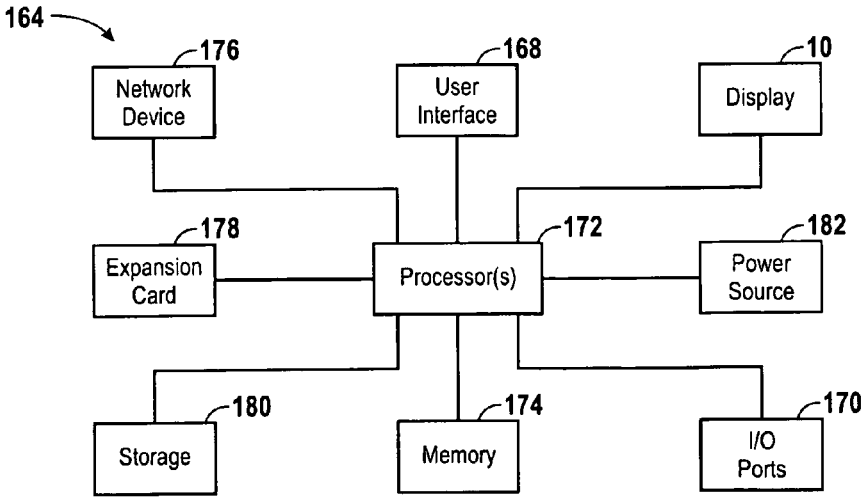

Other aspects of the electronic device 164 are illustrated by FIG. 13. The processor 172 may also be coupled to a network device 176, an expansion card 178, a storage device 180, and a power source 182. The network device 174 may include a wired or wireless networking device, such as a wi-fi module or a Bluetooth module. The expansion card 178 may include removeable memory media or a slot for removeable memory media, such as a memory stick, an SD memory card, or a micro-SD memory card. The storage 180 may include additional memory for storing media. In some embodiments, the storage 180 stores video or audio data, and the memory 174 stores an operating system and operational data of the electronic device 164. The power source 182 may include any of a variety of types of power sources, such as a DC power source for connecting to a wall outlet or a battery, e.g., a lithium ion battery or a nickel-metal hydride battery.

Other embodiments may include other types of electronic devices 164. For instance, the electronic device 164 may include a cellular communication module that allows the electronic device to transmit and receive data, such as voice data, over a cellular network. In some embodiments, the electronic device 164 may include a GPS module, and the memory 174 may store maps for displaying GPS position data on the LCD 10. The electronic device 164 may also be one of a variety of types of displays, such as a television, a dynamically updated photo frame, a monitor of a laptop, palmtop, or desktop computer, or one of a variety of types of equipment, such as an automated teller machine, a point-of-sale terminal, a medical device, or a manufacturing device. In some embodiments, the electronic device 164 is a hand-held gaming device, and the memory 174 stores one or more video games. The electronic device may also be a display module in a vehicle that displays information about the state of the vehicle, e.g., position, velocity, or an image from a vehicle-mounted camera.

What is claimed is:

1. A method, comprising:

aging a transistor on a liquid crystal display (LCD) panel, while leaving a control transistor substantially idle; and comparing a threshold voltage of the aged transistor to an estimate of an initial threshold voltage of the aged transistor, via a threshold voltage of the control transistor, to estimate a change in the threshold voltage of the aged transistor, wherein the threshold voltage for the aged transistor comprises a first gate voltage above which the aged transistor becomes conductive and the threshold voltage for the control transistor comprises a second gate voltage above which the control transistor becomes conductive.

2. The method of claim 1, wherein aging the transistor on the LCD panel comprises turning the transistor on for a substantial portion of the time in which the LCD panel is operating.

3. The method of claim 1, wherein comparing the threshold voltage of the aged transistor to the threshold voltage of the control transistor comprises:

turning to both the aged transistor and the control transistor off; and increasing a gate voltage of the aged transistor and a gate voltage of the control transistor at generally the same rate.

4. The method of claim 3, comprising determining whether the control transistor turns on at a lower gate voltage than the aged transistor.

5. The method of claim 3, comprising determining a difference in voltage between the threshold voltage of the aged transistor and the threshold voltage of the control transistor.

6. The method of claim 3, comprising determining whether the difference in voltage between the threshold voltage of the aged transistor and the threshold voltage of the control transistor is greater than a value.

7. The method of claim 3, comprising determining whether the threshold voltage of the aged transistor is greater than a value.

8. The method of claim 1, comprising storing a value indicative of the difference in threshold voltage in memory.

9. The method of claim 1, comprising adjusting an aspect of an LCD including the LCD panel in response to a result of the comparison.

10. The method of claim 9, comprising increasing a voltage applied to a gate of a gate-line transistor in response to a result of the comparison.

11. The method of claim 9, comprising disabling a first set of gate-line transistors and enabling a second set of gate-line transistors in response to a result of the comparison.

12. The method of claim 1, comprising signaling a user that the LCD panel or an electronic device including the LCD panel may need maintenance.

13. The method of claim 1, wherein aging the transistor on the LCD panel comprises turning the transistor on for at least 99% of the time in which the LCD panel is operating, and comparing the threshold voltage of the aged transistor to the threshold voltage of the control transistor comprises turning the control transistor on only during the comparison.

14. A device, comprising:

a liquid crystal display (LCD) panel comprising a plurality of gate-line transistors;

a transistor-degradation circuit formed on the LCD panel, wherein the transistor-degradation circuit comprises a control transistor, and wherein a support circuit is configured to keep the control transistor off during a substantial portion of the time in which the LCD panel is operating and configured to turn the control transistor on to compare a threshold voltage of the control transistor to a threshold voltage of a second transistor;

a driver integrated circuit coupled to the LCD panel; and the support circuit disposed on the driver integrated circuit and in communication with the transistor-degradation circuit.

15. The device of claim 14, wherein the transistor-degradation circuit is integrally formed on the LCD panel.

16. The device of claim 14, wherein the plurality of gate-line transistors is configured to control a voltage of gate lines in an array of pixels on the LCD panel.

17. The device of claim 14, wherein the support circuit is configured to keep the control transistor off during a substantial portion of the time in which the LCD panel is operating and turn the control transistor on only during a transistor-degradation test, and to keep the second transistor on for at least 99% of the time in which the LCD panel is operating.

18. The device of claim 14, comprising memory coupled to the support circuit, wherein the memory is configured to store a value indicative of a threshold voltage of a transistor in the transistor-degradation circuit.

19. The device of claim 14, wherein the driver integrated circuit is configured to adjust a voltage of a gate-line transistor in response to a signal from the transistor-degradation circuit.

20. The device of claim 14, comprising a processor, wherein the processor is configured signal a user in response to a signal from the transistor-degradation circuit.

21. A device, comprising:

a liquid crystal display (LCD) panel comprising a first plurality of transistors;

a transistor-degradation circuit disposed on the LCD panel and comprising a second plurality of transistors generally having a same electrical properties as the first plurality of transistors, wherein the transistor-degradation circuit is configured to estimate a change in threshold voltages for the first plurality of transistors over time based on a comparison of threshold voltages for the second plurality of transistors with initial threshold voltages for the second plurality of transistors, wherein the threshold voltages for the first plurality of transistors comprises a first gate voltage above which the first plurality of transistors becomes conductive and the threshold voltages for the second plurality of transistors comprises a second gate voltage above which the second plurality of transistors becomes conductive;

a driver IC coupled to the LCD panel; and a support circuit formed within the driver IC, wherein the support circuit is coupled to the transistor-degradation circuit by fewer than three signal paths.

22. The device of claim 21, wherein the second plurality of transistors are coupled to the support circuit through a single output signal path.

23. The device of claim 21, wherein the support circuit is coupled to the transistor-degradation circuit by a single output signal path.

24. The device of claim 23, wherein the support circuit comprises:

a comparator having an input terminal coupled to the single output signal path; and a counter having an input coupled to an output of the comparator.

25. The device of claim 24, comprising a register configured to output a reference voltage to the comparator, wherein the reference voltage is based on a count of the counter.

26. The device of claim 21, wherein the plurality of transistors comprises three transistors each having a terminal coupled to the support circuit by the single signal path.

27. The device of claim 21, wherein the plurality of transistors comprises a plurality of transistors disposed in series between a voltage source and the support circuit.

28. The device of claim 21, wherein the transistor-degradation circuit comprises a transistor having a first terminal coupled to the support circuit, a gate in communication with the support circuit via a capacitor, and a second terminal coupled to a clock signal.

29. The device of claim 21, wherein the support circuit is configured to adjust a voltage applied to a first plurality of transistors of the LCD panel based, at least in part on, the estimated change in the threshold voltages of the first plurality of transistors over time.

30. The device of claim 21, wherein the support circuit is configured to disable a first portion of the plurality of gate-line transistors of the LCD panel.

31. The device of claim 30, wherein the support circuit is configured to enable a second portion of the plurality of gate-line transistors of the LCD panel.

32. The device of claim 21, wherein the transistor-degradation circuit is configured to hold the second plurality of transistors in an on state for at least 99% of the time in which the LCD panel is operating.

33. A method, comprising:

measuring a property of a first transistor by conducting a first current through the first transistor and a signal path during only a first portion of a clock cycle;

measuring the property of a second transistor by conducting a second current through the second transistor and the signal path during only a second portion of the clock cycle; and adjusting a parameter of a liquid crystal display (LCD) panel based, at least in part, on a comparison of the property of the first transistor and the property of the second transistor.

34. The method of claim 33, comprising aging the first transistor, the second transistor, or both by turning on the first transistor, the second transistor, or both while displaying an image on an LCD.

35. The method of claim 33, wherein the property is a threshold voltage.

36. The method of claim 33, wherein the property is a change in threshold voltage.

37. The method of claim 33, comprising measuring a property of a third transistor by conducting a current through the third transistor and the signal path.

38. The method of claim 33, wherein measuring the property of the first transistor comprises comparing a voltage of the signal path to a reference voltage.

39. The method of claim 38, wherein measuring the property of the first transistor comprises varying the reference voltage based on a count of a counter.

40. The method of claim 38, wherein adjusting a parameter of an LCD panel comprises changing a voltage applied to a gate-line transistor on the LCD panel.

41. The method of claim 38, wherein adjusting a parameter of an LCD panel comprises disabling a first set of gate-line transistors on the LCD and enabling a second set of gate-line transistors on the LCD.

42. The method of claim 33, comprising aging the first transistor by keeping the first transistor in an on state for at least 99% of the time in which the LCD panel is operating, and wherein measuring the property of the second transistor comprises only turning the second transistor to an on state when the property of the second transistor is measured.

43. A device, comprising:

a liquid-crystal display (LCD) panel comprising a transistor-degradation circuit, wherein the transistor-degradation circuit is configured to output a signal corresponding to a difference between a threshold voltage of an aged transistor and a threshold voltage of a control transistor that is substantially unaged to indicate a change in threshold voltage of the aged transistor, wherein the threshold voltage of the control transistor corresponds with an initial threshold voltage of the aged transistor before it is aged, the threshold voltage for the aged transistor comprises a first gate voltage above which the aged transistor becomes conductive, and the threshold voltage for the control transistor comprises a second gate voltage above which the control transistor becomes conductive.

44. The device of claim 43, wherein the transistor-degradation circuit is configured to hold the aged transistor in an on state for a substantial portion of the time in which the LCD panel is operating and configured to hold the control transistor in an off state for the substantial portion of time in which the LCD panel is operating.

45. The device of claim 43, wherein the transistor-degradation circuit is configured to only hold the control transistor into an on state when comparing the threshold voltage of the control transistor to the threshold voltage of the aged transistor during a transistor degradation test, and to hold the aged transistor in an on state for at least 99% of the time in which the LCD panel is operating.

46. The device of claim 43, comprising a support circuit configured to control the transistor-degradation circuit during a transistor degradation test.

47. The device of claim 43, wherein the support circuit is disposed on a driver integrated circuit (IC) that is coupled to the LCD panel.

48. The device of claim 43, comprising an LCD in which the LCD panel is disposed, wherein the LCD includes a backlight and a driver integrated circuit coupled to the LCD panel.

49. The device of claim 48, wherein the electronic device is a handheld media player.

50. The device of claim 43, comprising an electronic device in which the LCD is disposed, wherein the electronic device includes memory and a processor coupled to the LCD.

* * * * *